US008400243B2

(12) United States Patent
Okada et al.

(10) Patent No.: US 8,400,243 B2
(45) Date of Patent: Mar. 19, 2013

(54) ELECTROMAGNETIC SWITCH WITH TWO ELECTROMAGNETS

(75) Inventors: Tarou Okada, Owariasahi (JP); Mitsuhiro Murata, Niwa-gun (JP); Takahisa Inagaki, Nishio (JP); Masami Niimi, Handa (JP); Kiyokazu Haruno, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/405,707

(22) Filed: Feb. 27, 2012

(65) Prior Publication Data

US 2012/0218063 A1 Aug. 30, 2012

(30) Foreign Application Priority Data

Feb. 25, 2011 (JP) ..... 2011-039869

(51) Int. Cl.
*H01F 5/00* (2006.01)
*H01F 7/00* (2006.01)

(52) U.S. Cl. ..... 335/278; 335/259; 335/266; 335/267; 335/268

(58) Field of Classification Search ..... 335/106, 335/131, 132, 255, 259, 266–268, 278
See application file for complete search history.

(56) References Cited

U.S. PATENT DOCUMENTS

2009/0183595 A1 7/2009 Niimi

FOREIGN PATENT DOCUMENTS

JP A-2009-191843 8/2009

*Primary Examiner* — Ramon Barrera
(74) *Attorney, Agent, or Firm* — Oliff & Berridge, PLC

(57) ABSTRACT

There is an electromagnetic switch for a starter includes a first and second electromagnet and a frame and a cover. The first and second electromagnets are set alongside in the frame. The first and second electromagnets are configured to change a position with respect to the cover by rotating about the axis with respect to the frame.

7 Claims, 12 Drawing Sheets

(A-A CROSS-SECTION)

ELECTROMAGNETIC SWITCH WITH TWO ELECTROMAGNETS

CROSS-REFERENCE TO RELATED APPLICATION

This application is based on and claims the benefit of priority from earlier Japanese Patent Application No. 2011-39869 filed on Feb. 25, 2011, the description of which is incorporated herein by reference.

BACKGROUND

1. Technical Field

The present invention relates to an electromagnetic switch. In particular, the present invention relates to an electromagnetic switch provided with a single cylindrical frame and two electromagnets which are accommodated in the frame in parallel with each other in the axial direction of the solenoids.

2. Related Art

One of conventional electromagnetic switches used for a starter of a vehicle is disclosed in Japanese Patent Laid-open Publication No. JP-A-2009-191843.

This electromagnetic switch has a first electromagnet for moving the pinion gear of the starter to a ring gear of an engine, and a second electromagnet for closing and opening a main switch. This switch additionally has a cylindrical frame in which the two electromagnets are set in parallel with each other in the axial direction of the switch, and a plastic cover which covers an open end of the frame and is fixed to the frame.

FIG. 10 shows a schematic view of the electromagnetic switch viewed in the axial direction.

Two terminal bolts 110, 120 connected to a motor circuit are fixed to the plastic cover 100. A first exciting terminal 130 to be connected to a first coil of the first electromagnet is shown at the right side of the two bolts, and a second excitation terminal 140 to be connected to a second coil of the second electromagnet is shown at the left side of the two bolts in FIG. 10.

The first coil of the electromagnetic switch in JP-A-2009-191843 includes an attracting coil and a holding coil. In addition to the first and second excitation terminal 130, 140, the electromagnetic switch has a negative terminal 150 which is connected to a negative end of the attracting coil. The negative terminal 150 is projected from the plastic cover 100 to the axial direction, electrically connected to the terminal bolt 120 of the motor through an attachment clasp.

As shown in FIG. 10, the first and second excitation terminals 130, 140 face each other across the two terminal bolts 110, 120. Therefore it is necessary to wire up one of the excitation terminals 130, 140 before attaching the starter to the engine block. For example, when the engine block and the second excitation terminal 140 are arranged at the left side of the plastic cover 100 in FIG. 10, it is difficult to wire up the second excitation terminal 140 with the starter attached to the engine block. Accordingly, it is required to wire up the second excitation terminal 140 before attaching the starter to the engine block and to wire up the first excitation terminal 130 after attaching the starter to the engine block. This needs twice work of wiring before and after attaching the starter to the engine, and work efficiency is low.

The positional relationship of terminals to be wired up is different according to the engine model. It is necessary to change the position of the first and second excitation terminals 130, 140 according to the difference.

Here a method of change the position of the first and second excitation terminals 130, 140 by rotating about an axis of the frame is discussed.

The terminal which is wired up after attaching the starter to the engine is defined as a basis position terminal (first excitation terminal 130 in the case described above). When the first and second excitation terminal 130, 140 are rotated about the axis with respect to the frame for changing the position of the basis position terminal from lower right to lower left, the positions of the first and second excitation terminal 130, 140 move from the position shown in FIG. 11 to the position shown in FIG. 12 with the positional relationship among the negative terminal, the first and second excitation terminal 130, 140 kept.

In the above described case, the negative terminal 150 is positioned in a contact space. The contact space is the space where a main switch is arranged. The main switch has a pair of fixed contacts which are connected to the two terminal bolts 110, 120, and a movable contact which closes and opens between the pair of fixed contacts. The electromagnetic switch in JP-A-2009-191843 is configured so that the first and second excitation terminals 130, 140 face each other across the contact space. In such an electromagnetic switch, rotating the first and second excitation terminals 130, 140 about the axis cannot change the position of the basis position terminal to the desired position often.

In the case of changing the position of the basis position according to the engine model and the like, for example as shown in FIG. 13 and FIG. 14, it is required to set the appropriate positional relationship between the first and second excitation terminals 130, 140 such that the other terminal wired up in advance (the second excitation terminal in FIG. 12) and the negative terminal 150 don't reach to the contact space. The change needs changing a position defined as a taking position for taking the first coil from a bobbin around which the first coil is wound. Therefore setting a plurality of variations according to different positions of terminals needs a plurality kind of bobbins according to the variations.

This cause the number of the component and the equipment used for setting the terminals in the electromagnetic switches according to a plurality of variations to increase. As a result, the production cost increases.

SUMMARY

In light of the foregoing conditions, it is an object to provide an electromagnetic switch in which the first and second electromagnets can be used in common for use in plural applications where the setting positions of the first and second excitation terminals differ from each other depending on types of engines.

An exemplary embodiment provides an electromagnetic switch for a starter including a first electromagnet which has a first coil to be excited by an electric current flowing via a first excitation terminal and uses a magnetic force generated by the first coil to move a pinion gear of a starter in an axial direction; a second electromagnet which has a second coil to be excited by an electric current via a second excitation terminal, and opens and closes a main switch depending on an excitation status of the second coil, the main switch making and breaking a current circuit of a motor; a frame in which the first and second electromagnets are set alongside each other in the axial direction, the frame extending along the axial direction, an end of the axial direction of the frame opening; a cover which covers the open end of the frame and forms a contact space inside of the cover, the main switch arranged in the contact space; two terminal bolts which are fixed to the cover, composing a part of the current circuit, and connecting the main switch with a part of the current disposed outside of the cover; and a terminal fixing portion to which connecting ends of the first and second excitation terminal are fixed, the connecting ends to be connected respectively to the first and second cons, the terminal fixing portion disposed inside of the frame. The first and second electromagnets are configured to change position with respect to the cover by rotating about the axis with respect to the frame.

DETAILED DESCRIPTION OF PREFERRED EMBODIMENTS

Referring to FIGS. 1 to 9, a first embodiment and its modifications according to an electromagnetic switch apparatus (hereinafter, simply referred to an electromagnetic switch) will now be described.

Figure 5:
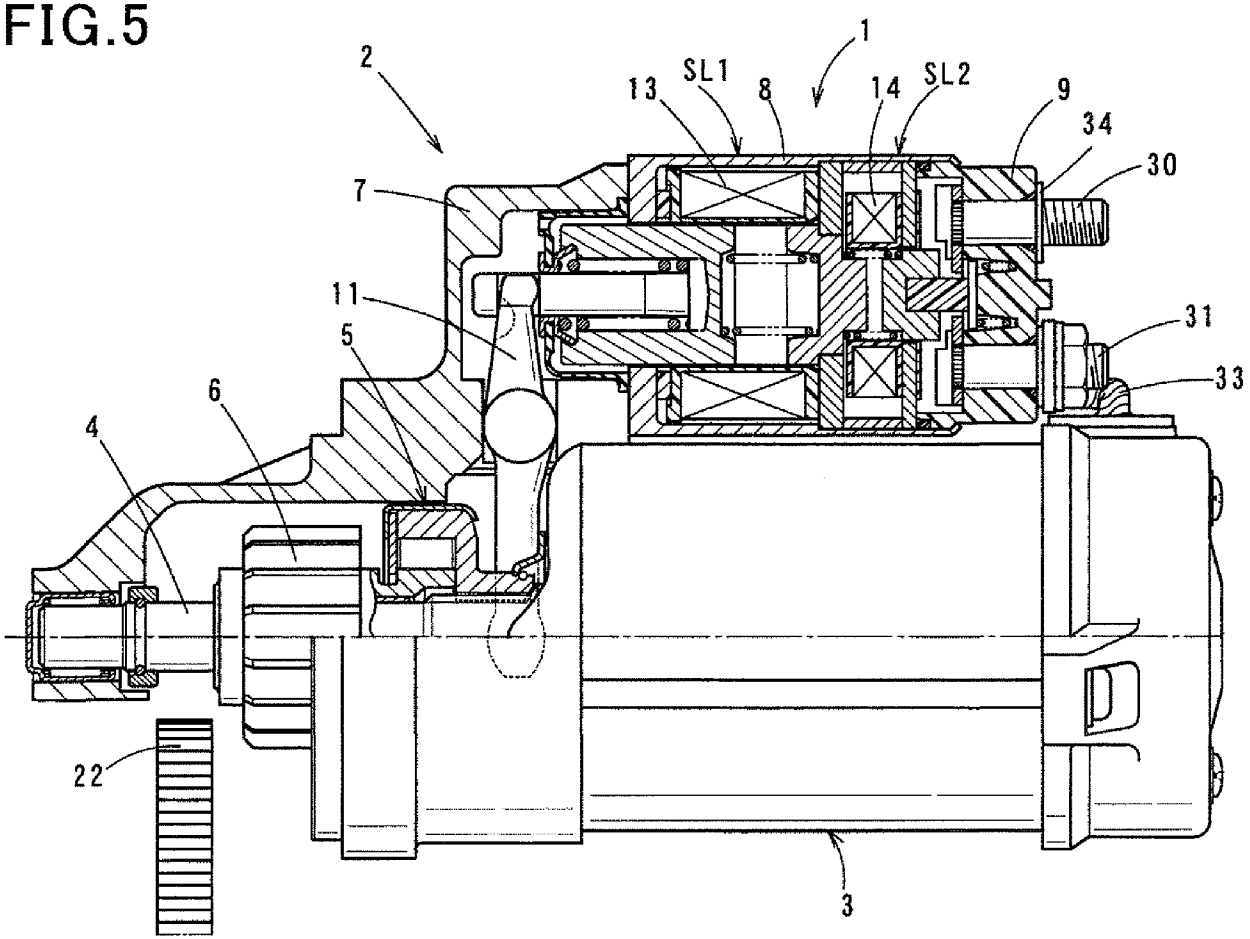
FIG. 5 is a partial sectional view showing a starter in which the electromagnetic switch is mounted.

An electromagnetic switch 1 of the first embodiment is used in an engine starter 2 of a vehicle (shown in FIG. 5). The starter 2 has an idling stop function which automatically controls to stop and start an engine of a vehicle.

By the idling stop function, the fuel supply to the engine is automatically cut to stop the engine, for example when the vehicle is temporarily stopped because of a stop signal or a traffic jam. The engine is automatically restarted by the idling stop function when an operation for start of the vehicle by the user (an operation of taking off a brake pedal, gear throws for selecting a drive mode, and the like) is performed and conditions for restart are satisfied.

The starter 2 has a main unit, an output shaft 4, a clutch 5, and a pinion gear 6, in addition to the electromagnetic switch 1, and, as shown in FIG. 5 and the main unit transmits, to the output shaft 4, rotary torque generated in a motor 3 and increased by a speed reducer (not shown in the figures). Further, the main unit of the starter 2 transmits rotary torque transmitted to the output shaft 4 to the pinion gear 6 through the clutch 5 arranged outside of the output shaft 4. The structure of the main unit is known, and hence the detailed explanation is simplified or omitted from being described in detail.

The electromagnetic switch 1 of this embodiment is described in detail as follows.

Figure 1:
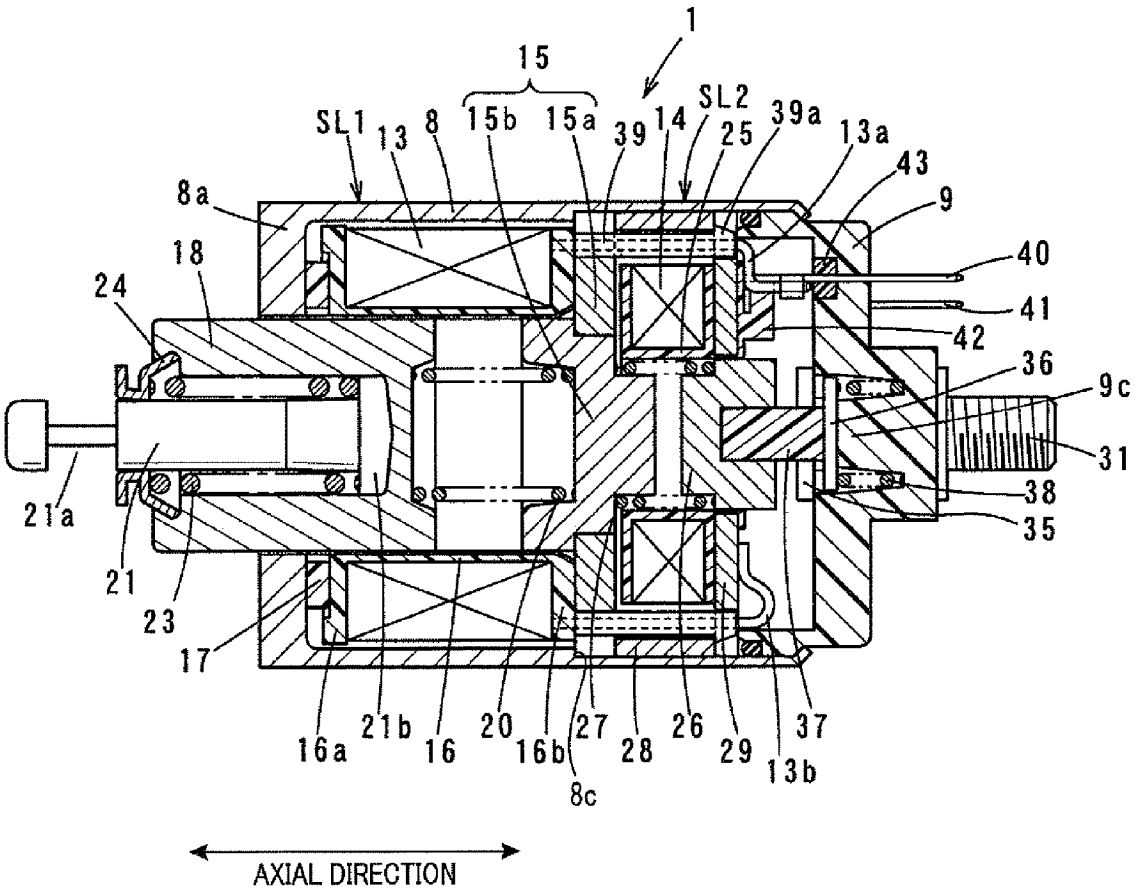
FIG. 1 is a sectional view showing an electromagnetic switch according to an embodiment of the present invention.

The electromagnetic switch 1 in FIG. 1 has a cylindrical frame 8 which has an open end and an bottom 8*a* in the axial direction, an electromagnet unit SU (refer to FIG. 4) inserted in the frame 8, and a plastic cover 9 which covers the open end of the frame 8 and fixed to the frame 8. The bottom 8*a* is fixed in contact with contacting a starter housing 7 (refer to FIG. 5). The frame 8 is made from metal.

Figure 4:
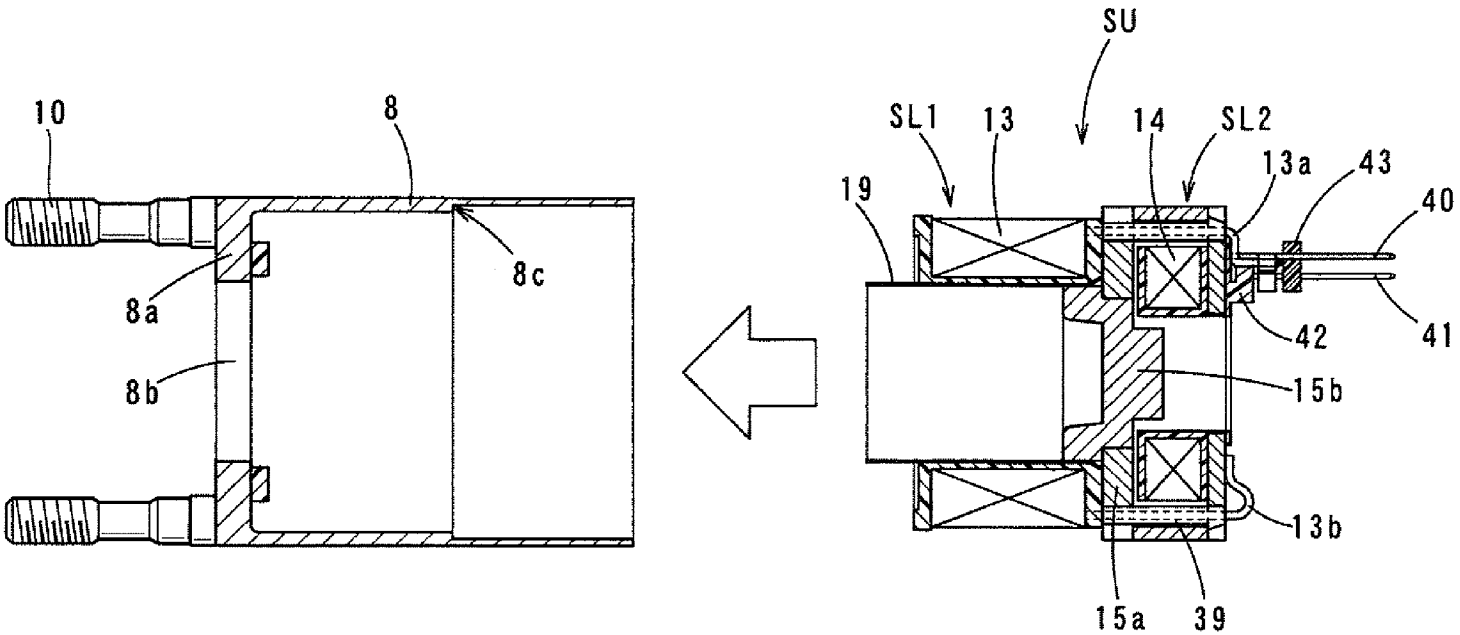
FIG. 4 is a view explaining, in sections, a step of inserting a solenoid unit into the frame.

The frame 8 in FIG. 4 has a circular hole 8*b* opening at the center of the bottom 8*a*, and the frame 8 is fixed to the starter housing 7 through two stud 10, 10 attached to outside of a radial direction of the circular hole 8*b*.

The frame 8 has the same outer diameter from the bottom 8*a* to the open end. The inner diameter of the open end side of the frame 8 is larger than the bottom side, and the open end side of the frame 8 is thinner than the bottom 8*a* side. The inner periphery of the frame 8 between the open end side and the bottom 8*a* side is provided with a step 8*c*.

The electromagnet unit SU has a first electromagnet SL1 and a second electromagnet SL2, and the first and second electromagnets SL1, SL2 are unified with arranged alongside in the axial direction (the cross direction in FIG. 4) of the frame 8, as shown in FIG. 4. The first electromagnet SL1 drives a shift arm 11 (refer to FIG. 5) to move the pinion gear 6 in a counter-motor direction (the left direction in FIG. 5) with the clutch 5. The second electromagnet SL2 opens and closes a main switch (described below) for breaking and making a current pathway of a motor circuit.

Figure 7:
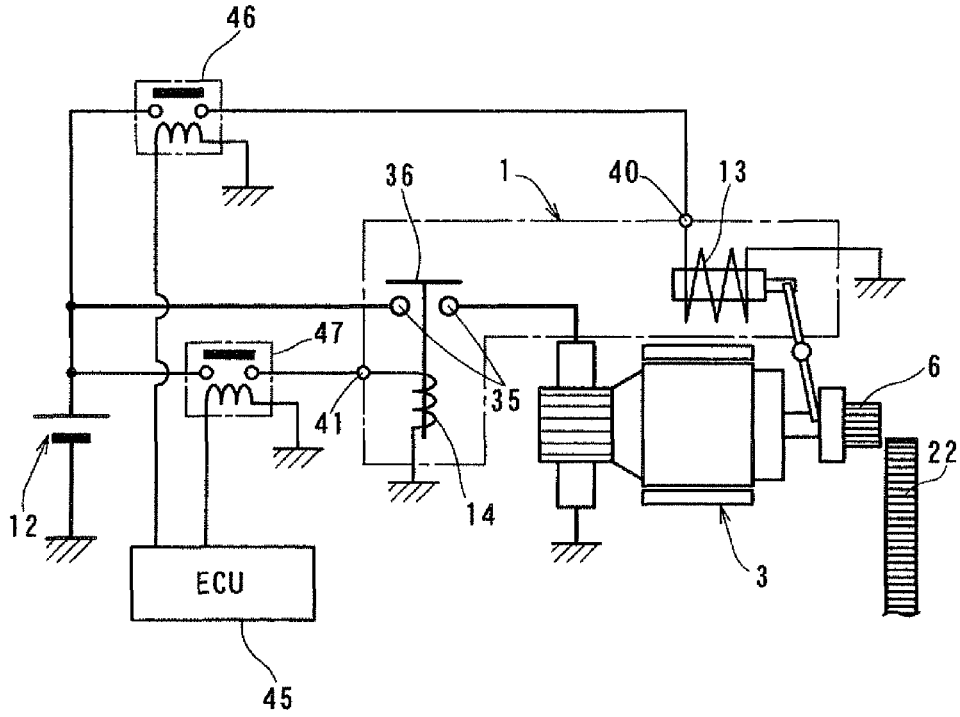
FIG. 7 is an electrical circuit diagram showing the electric circuitry of the starter.

The motor circuit is shown in FIG. 7, a current circuit for applying electrical current from a battery 12 to a motor 3, and the current from the battery 12 to the motor 3 is allowed to flow and interrupted by closing and opening the main switch.

The first electro magnet SL1 has a first coil 13 which generates a magnetic force and the second electromagnet SL2 has a second coil 14 which generates a magnetic force. The first and second coils 13, 14 have a common fixed iron core 15 arranged therebetween.

The fixed iron core 15 has an annular core plate 15*a* and a core portion 15*b*. The core portion 15*b* is press-fitted into the hole of the core plate 15*a* so they are combined as a unit of the fixed iron core. The fixed iron core 15 is located at a position in the axial direction of the frame 8, at the position on one side of the thickness direction of the core plate 15*a* contacting the step 8*c* of the frame 8.

As shown FIG. 1, the electromagnet SL1 has a plastic bobbin 16 having a pair of flange plates 16*a*, 16*b* around which the first coil 13 is wound. The electromagnet SL1 is put in the bottom side of the frame 8 with an elastic body 17 (gum elastic, a disc spring, etc.) disposed between the flange plate 16*a* and the bottom surface 8*a* of the frame 8.

An elastic force generated by the elastic body 17 makes the other flange plate 16*b* pressed to the core plate 15*a*. This limits motion of the bobbin 16 in the axial direction.

A plunger 18 is disposed inside of the first coil 13. The plunger 18 faces an attraction face (the left end face in FIG. 1) of one side of the core portion 15*b* and moves in the axial direction. A cylindrical sleeve 19 (refer to FIG. 4) is inserted inside the bobbin 16. The cylindrical sleeve 19 guides the plunger 18 put therein in the axial direction.

A return spring 20 is disposed between the iron core 15 and the plunger 18. The plunger 18 is attracted to the attraction face of the core portion 15*b* against a reaction force generated by the return spring 20 when the first coil 13 is energized and the core portion 15*b* is magnetized. The plunger 18 is pushed to the counter-core portion direction (an opposite direction of the core portion 15*b*, that is the leftward direction in FIG. 1) by the reaction force of the return spring 20 when the energization of the first coil 13 is stopped.

The plunger 18 is formed in a substantially cylindrical shape having a bottom at one end of the axial direction and opening at the other end (the left direction in FIG. 1). A joint 21 and a drive spring 23 are inserted into the hole of the plunger 18. The joint 21 used to transmit a movement of the plunger 18 to the shift arm 11. The drive spring 23 accumulates a reaction force to move the pinion gear 6 to a position where the pinion gear 6 engages with a ring gear 22 (refer to FIG. 5).

The joint 21 is formed in a rod-shape. A groove-like fitting depression 21*a* is formed at one end of the joint 21. The end having the fitting depression 21*a* sticks out from the opening of the plunger 18, and the one end of the shift arm 11 is fitted in the fitting depression. The joint 21 has a flange portion 21*b* at the opposite end of the fitting depression 21*a*. The flange portion 21*b* has an outer diameter such as to slide inside of the plunger 18. The flange portion 21*b* is subjected to a load of the drive spring 23 to be pressed to the bottom of the plunger 18.

The drive spring 23 is disposed between the flange portion 21*b* of the joint 21 and a washer 24 which is calked and fixed to the open end of the plunger 18. The drive spring 23 accumulates a reaction force for moving the shift arm 11 as follows. When the plunger 18 is attracted and moves to the core portion 15*b*, the pinion gear 6 is pushed to a counter-motor direction (the direction opposite to the motor 3) through the shift arm 11. The drive spring 23 is compressed to accumulate the reaction force, while the plunger 18 is attracted to the core portion 15*b* after the one end face of the axial direction of the pushed pinion gear 6 contacts the one end face of the axial direction.

As shown FIG. 1, the electromagnet SL2 has a plastic bobbin 25 around which the second coil 14 is wound, and is put in the other side (counter-bottom side, that is the side opposite to the bottom) of the frame 8.

A movable iron core 26 is disposed inside of the second coil 14. The movable iron core 26 faces the other attraction face (the right end face in FIG. 1) of the core portion 15*b* and moves in the axial direction.

A return spring 27 is disposed between the core portion 15*b* and the movable iron core 26. The movable iron core 26 is attracted to the other attraction face of the core portion 15*b* against a reaction force generated by the return spring 27 when the second coil 14 is energized and the core portion 15*b* is magnetized. The movable iron core 26 is pushed to the counter-core portion direction (an opposite direction of the core portion 15*b*, that is the right direction in FIG. 1) by the reaction force of the return spring 27 when the energization of the second coil 14 is stopped.

A cylindrical auxiliary yoke 28 is provided outside of the radial direction of the second coil 14, a magnetic plate 29 is provided on the counter-core plate side (the side opposite to the core plate 15*a*) of the axial direction of the second coil 14, and the auxiliary yoke 28 and the magnetic plate 29 configure a part of a magnetic circuit.

The auxiliary yoke 28 is located at a position in the axial direction, at the position the one end face of the axial direction of the auxiliary yoke 28 contacting the cover side face (the face of the right side in FIG. 1) of the core plate 15*a*.

The magnetic plate 29 is disposed to cross the axial direction of the second coil 14, and is formed in a ring shape so that the movable iron core 26 can move in the axial direction through the hole in the magnetic plate 29. The magnetic plate 29 is formed with the bobbin 25 as a unit by insert molding.

Figure 2B:
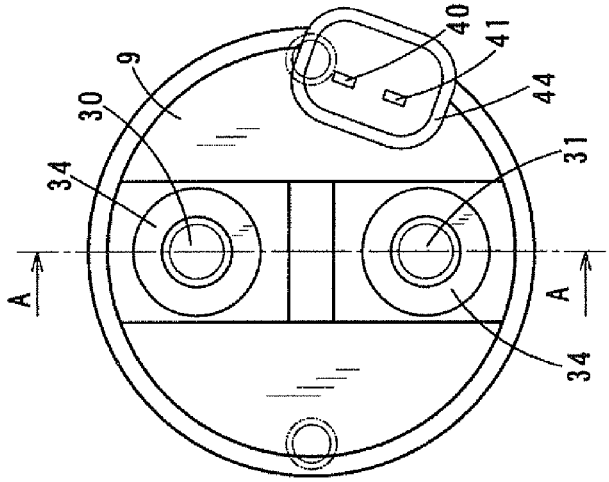
FIG. 2B is an axial view showing a side of the electromagnetic switch, which shows a side of a cover made of resin which is attached to a side of the electromagnetic switch.
Figure 2A:
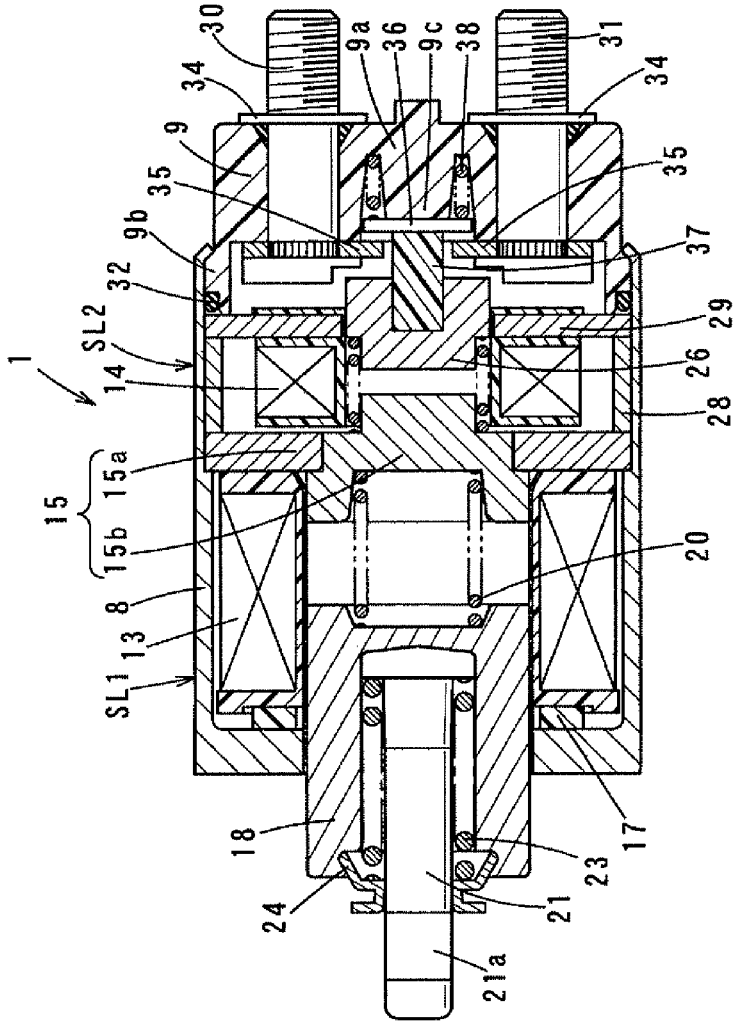
FIG. 2A is a sectional view of the electromagnetic switch, which is taken along an A-A line shown in FIG. 2B.

As shown FIG. 2A, the plastic cover 9 is formed in a nearly cylindrical shape having a bottom portion 9*a* and a side portion 9*b* which extends from the periphery of the bottom portion 9*a* in the axial direction. Two terminal bolts are attached to the bottom portion 9*a*. The side portion 9*b* is inserted inside of the frame 8. The side portion 9*b* has a large-diameter portion whose outer diameter is larger than the other portion of the side portion 9*b*. By swaging the is frame 8 to the large-diameter portion of the side portion 9*b*, the plastic cover 9 is fixed to the frame 8.

The plastic cover 9 is set to the position in the axial direction at which the end of the side portion 9*b* contacts the magnetic plate 29. An O-ring is provided in a groove which is formed on the outer surface of the side portion 9*b* such as to extend along the circumferential direction. The O-ring seals gaps between the plastic cover 9 and the frame 8 to prevent water or something in external space of the plastic cover 9 and the frame 8 from entering the internal space.

One of the two terminal bolts 30, 31 is a B terminal bolt 30 to which a battery cable connects, the other is a M terminal bolt 31 to which a lead wire 33 of the motor 3 (refer to FIG. 5 and FIG. 6) connects. The two terminal bolts 30, 31 are attached to the plastic cover 9 through respective holes which penetrate through the plastic cover 9 in the axial direction, and fixed to the plastic cover 9 by a calking washer 34.

A contact space (the area surrounded by two dashed-dotted lines in FIG. 3) is formed inside of the plastic cover 9. A pair of fixed contacts 35, 35 and a movable contact 36 configure the fore mentioned main switch, and are disposed in the contact space.

The pair of fixed contacts electrically and mechanically connects to the two terminal bolts 30, 31. For example, the two terminal bolts 30, 31 are respectively pressed into respective holes formed in the pair of fixed contacts 35, 35, and fixed to the pair of fixed contacts 35, 35.

Alternatively, the two terminal bolts 30, 31 are provided with depressions by knurling for serration-fitting, the knurled parts of the two terminal bolts 30, 31 are pressed into holes formed in the pair of fixed contacts 35, 35, and fixed to the pair of fixed contacts 35, 35 as shown in FIG. 2A.

The two terminal bolts 30, 31 and the pair of fixed contacts may be made of different metal materials from each other. For example, the fixed contact 35 may be made of copper or other materials having high electric conductivity, and the terminal bolts 30, 31 may be made of iron or other materials having high mechanical strength.

Further, the terminal bolts 30, 31 made of iron may be plated with copper. Thus the copper plating can increase the electric conductivity of the terminal bolts 30, 31, while the terminal bolts have high mechanical strength originating in iron.

Moreover, the fixed contact 35 and the terminal bolt 30 (31) may be formed as a unit; for example heads of the terminal bolts 30 (31) may be used as the fixed contact 35.

The movable contact 36 is supported by the movable iron core 26 through a plastic shaft 37 fixed to the movable iron core 26, and disposed closer to the counter-movable iron core side (the side opposite to the movable iron core 26; that is the right side in FIG. 1) than the pair of fixed contacts 35, 35 is. A contact pressure spring 38 is disposed in the counter-movable iron core side than the movable contact 36, so the movable contact 36 is subjected to a load of the contact pressure spring 38 to be pressed to the shaft 37. The initial load of the contact pressure spring is set smaller than the initial load of the return spring 27 so that the movable contact 36 is pushed to a projection 9*c* formed in the bottom portion 9*a* of the plastic cover 9 with the contact pressure spring 38 compressed as shown FIG. 1 and FIG. 2A when the second coil 14 is not energized.

When the movable contact 36 pressed by the contact pressure spring 38 contacts the pair of fixed contacts, the main switch is turned to a closed state (ON) where both the fixed contacts 35, 35 are electrically connected each other through the movable contact 36. On the other hand, when the movable contact 36 moves away from the pair of fixed contacts 35, 35, the main switch is turned to a opened state (OFF) where the electrically connection between both the fixed contacts are broken.

Next, a termination process of the first and second coils is explained.

Start and end terminals 13*a*, 13*b* of the first coil 13 are taken from the bobbin 16 to the axial direction through two guide members 39, 39 which are plastic-molded with the bobbin 16 as a unit, as shown FIG. 1.

As shown FIG. 1, the guide members 39, 39 extends from the flange plate 16*b* which is adjacent to the core plate 15*a* to the plastic cover 9 side of the axial direction, and the ends of the guide members 39, 39 are provided with a hook-like attachment portion 39*a*.

Pathways of terminals 13*a*, 13*b* are respectively formed in the guide members 39, 39. For example, the pathway is formed as a hole penetrating through the guide member 39 along the extending direction, or a groove along the extending direction in the guide member 39.

As shown FIG. 4, the attachment portion 39*a* is hooked on the end face of the axial direction of the auxiliary yoke 30, so the attachment portion 39*a* serves as a combining means that combines the first and second electromagnets SL1, SL2.

Figure 3:
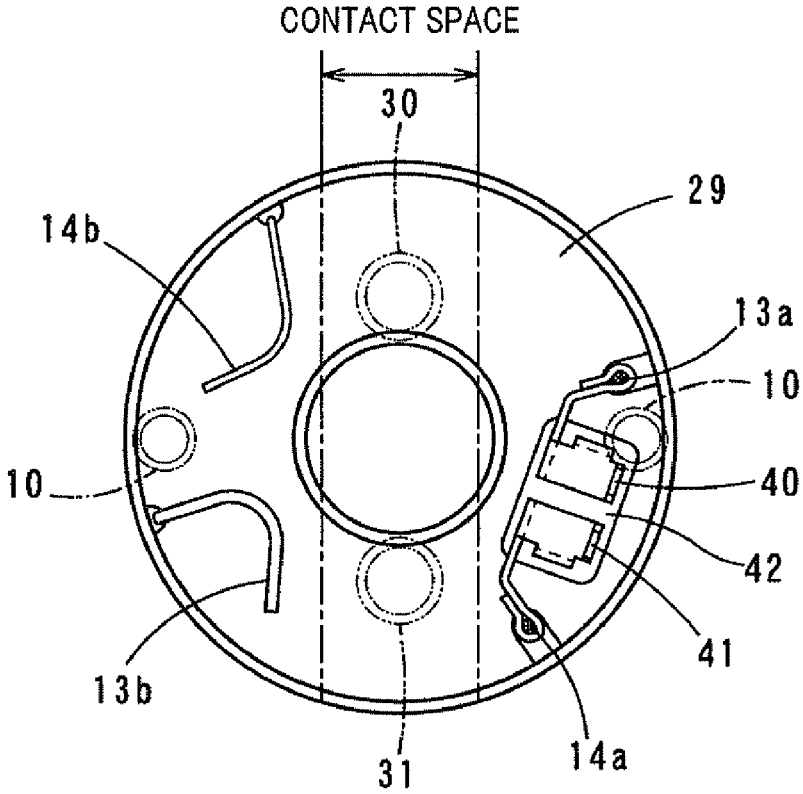
FIG. 3 is an axial view showing the electromagnetic switch with the cover removed.

The terminal 13*a* of the first coil 13 is taken from the end of the guide member 39, and connected to a first excitation terminal 40 (refer to FIG. 3, FIG. 4). The other terminal 13*b* of the first coil is taken from the end of the guide member 39, and connected to a face of the counter-coil side (the side opposite to the second coil 14) of the magnetic plate 29 by welding or something, as shown FIG. 3. The connection of the terminal 13*b* and the magnetic plate 29 is a ground connection.

Start and end terminals 14*a*, 14*b* (refer to FIG. 3) of the second coil 14 are taken from the bobbin 25. The terminal 14*a* is connected to a second excitation terminal 41 (refer to FIG. 1, FIG. 3), and the other terminal 14*b* is connected to the face of the counter-coil side of the magnetic plate 29 by welding or something. The connection of the terminal 14*b* and the magnetic plate 29 is a ground connection.

The first and second excitation terminals 40, 41 are connected to the battery 12 and energize the first and second coils 13, 14. The one end of the first excitation terminal 40 is inserted and fixed to a terminal fixing portion 42 (refer to FIG. 1, FIG. 4), and the other end penetrates the plastic cover 9 in the axial direction and is taken outside of the plastic cover 9. In similar way, the one end of the second excitation terminal 40 is inserted and fixed to the common terminal fixing portion 42, and the other end penetrates and is taken outside of the plastic cover 9. The terminal fixing portion 42 is plastic-molded with the bobbin 25 as a unit, the second coil 14 wound around the bobbin 25.

Figure 6:
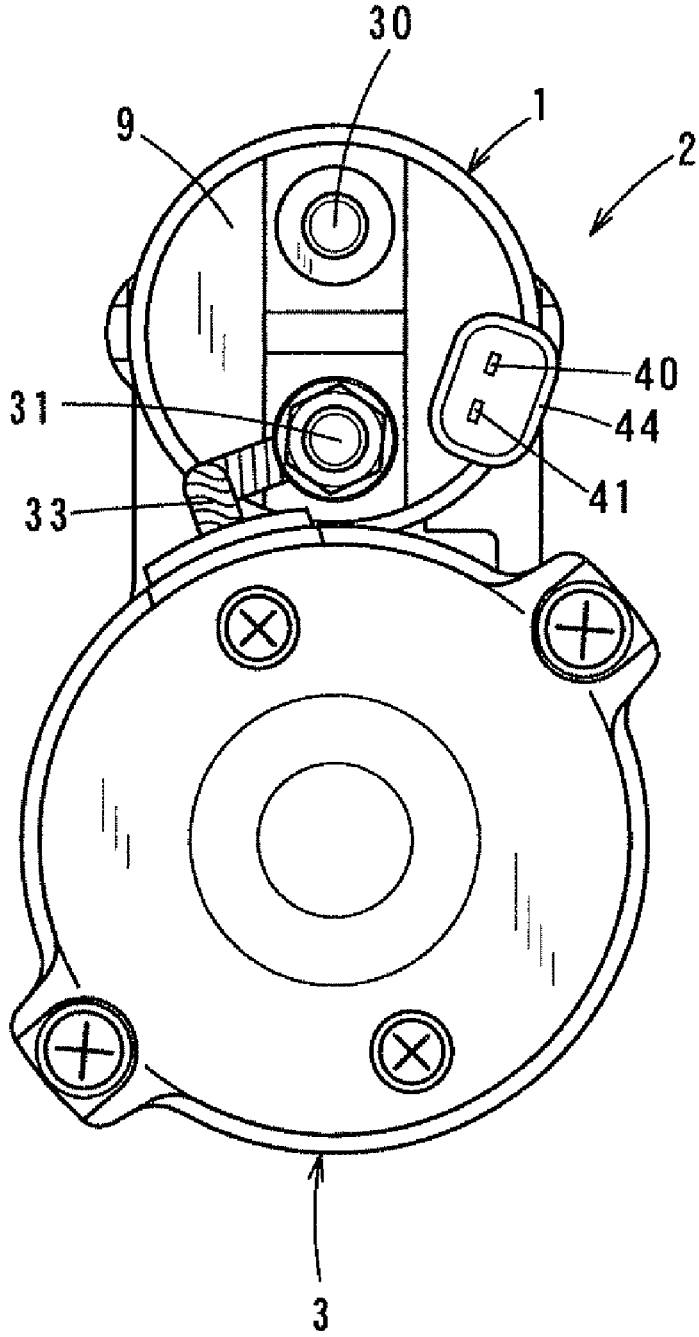
FIG. 6 is an axial view showing the rear side of the starter.

The first and second excitation terminals 40, 41 as shown FIG. 3 are arranged in one place on the magnetic plate 29 as dose together as possible, but ensuring the insulation between the first and second excitation terminals 40, 41. The first and second excitation terminals 40, 41 are arranged in the one side of a radical direction across the two terminal bolts 30, 31, as shown in FIG. 2B and FIG. 6. The first and second excitation terminals 40, 41 are is intensively arranged in one place.

The plastic cover 9 is provided with two holes penetrating the bottom portion 9*a* thereof, the first and second excitation terminals 40, 41 are taken outside of the plastic cover 9 through the two holes, respectively. The first and second excitation terminals 40, 41 are fitted with a common rubber sealing part 43 which seals the two holes of the plastic cover 9. The sealing part 43 is inserted by the first and second excitation terminals 40, 41, and attached to a groove portion formed inside of the plastic cover 9 by press-fitting.

As shown FIG. 2B and FIG. 6, the plastic cover 9 is provided with a connector fitting portion 44. The connector fitting portion 44 surrounds the periphery of the first and second terminals 40, 41 together which are taken outside of the space surrounded by the plastic cover 9 and the frame 8.

An operation for engine starting is explained.

The first electromagnet SL1 and the second electromagnet SL2 of the electromagnetic switch 1 are independently controlled by an idling stop electronic control unit (ECU, refer to FIG. 7) 45 respectively.

Signals, for example an engine rotation signal, a position signal of a transmission lever or an ON/OFF signal of a brake switch are input into the idling stop ECU 45 through an engine ECU (not shown) which controls operating conditions of the engine. When the idling stop ECU 45 determines a satisfaction of a condition for stopping the engine based on those signals, the idling stop ECU 45 outputs an engine stop signal into the engine ECU.

The idling stop ECU 45 detects a restart request when an operation for start of the vehicle (an operation of taking off a brake pedal, gear throws for selecting a drive mode, etc.) is performed by the driver after the idling stop is performed. The detection allows the idling stop ECU 45 to output a restart request signal into the engine ECU and to output an ON signal for operating the electromagnetic switch 1.

As an example of an occasion where the idling stop function is performed, an operation which is performed when the restart request is detected in an engine stop process is explained.

When the restart request is detected in an engine stop process, at first, the idling stop 45 outputs an ON signal to the first electromagnet SL1. This signal makes a first starter relay 46 (refer to FIG. 7) in ON state, the electric power is supplied from the battery 12 to the first excitation terminal 40, the first coil 13 connected to the first excitation terminal 40 is energized, and the plunger 18 is attracted to the magnetized core portion 15*b* to move.

The movement of the plunger 18 makes the pinion gear 6 move to the counter-motor direction thorough the shift arm 11, and the end face of the pinion gear 6 contacts the end face of the ring gear 22. At this time, the engine does not stop entirely. In other words the ring gear 22 slows down but still rotates. Once the ring gear 22 rotates to reach a position where the ring gear 22 can engage with the pinion gear 23, the reaction force accumulated in the drive spring 23 allows the pinion gear 6 to engage with the ring gear 22.

An ON signal to the second electromagnet SL2 is later by a predetermined time (for example, 30 ms-40 ms) than the output timing to the first electromagnet SL1 and output by the idling stop ECU 45. This signal makes a second starter relay 47 (refer to FIG. 7) in ON state, the electric power is supplied from the battery 12 to the second excitation terminal 41, the second coil 14 connected to the second excitation terminal 41 is energized, and the movable iron core 26 is attracted to the magnetized core portion 15*b* to move.

With the movement of the movable iron core 26, the movable contract 36 is forced to contact the pair of the fixed contacts 35, 35 by the contact pressure spring 38, and the main switch is closed. This makes the motor 3 energized by the battery 12, the motor 3 generates a torque, the torque is transmitted to the output shaft 4, and further the torque is transmitted from the output shaft 4 to the pinion gear 5 through the clutch 5. At this time, the pinion gear 6 is engaging with the ring gear 22. Therefore the torque generated by the motor 3 is transmitted from the pinion gear 6 to the ring gear 22, so cranking can be performed immediately.

In this embodiment, the first and second excitation terminals 40, 41 are closely fixed to the common terminal fixing portion 42 which is plastic-molded with the bobbin 25 of the second coil 24 as a unit. Therefore the electromagnet unit into which the first and second electromagnets SL1, SL2 are combined can be rotated about the axial of the frame 8 with respect to the frame 8 to change an attachment position. This allows the two excitation terminals 40, 41 to be set at a desired position out of the contact space (refer to the FIG. 3) viewed from the axial direction.

The attachment of the electromagnet unit SU to the frame 8 by rotation about the axis allows the two excitation terminals 40, 41 to be set at different positions depending on different wiring according to the engine model or something.

Figure 8A:
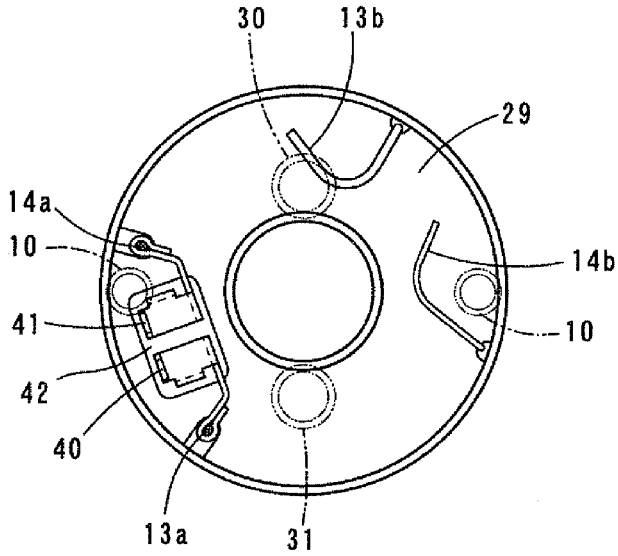
FIGS. 8A, 8B and 8C are various axial views showing a side of the electromagnetic switch with the cover removed.
Figure 8B:
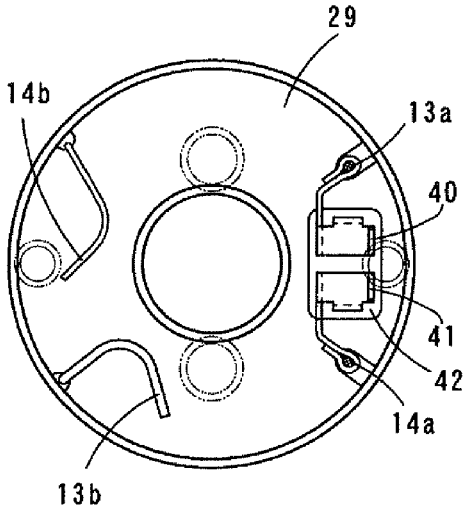
Figure 8C:
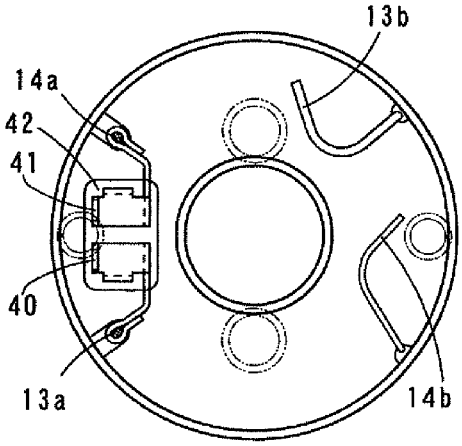

In this embodiment, the two excitation terminals 40, 41 are disposed at lower right in FIG. 3 with respect to the two terminal bolts 30, 31. The rotation of the electromagnet unit SU about the axial of the frame 8 to change the attachment position to the frame 8 is allows the two excitation terminals 40, 41 to be set at desired positions out of the contact space viewed from the axial direction, as shown in FIGS. 8A, 8B and 8C.

Figure 9A:
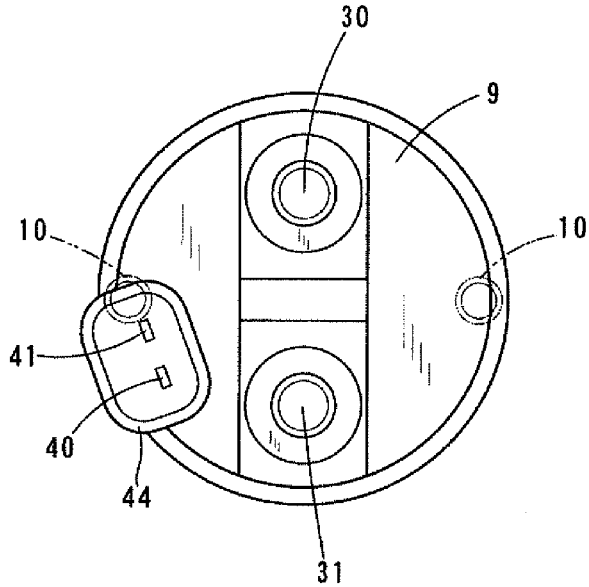
FIGS. 9A, 9B and 9C are various axial views showing a side of the electromagnetic switch viewed from the cover side.
Figure 9B:
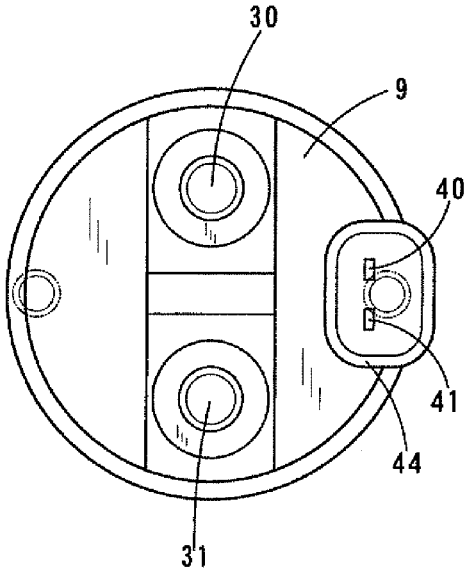
Figure 9C:
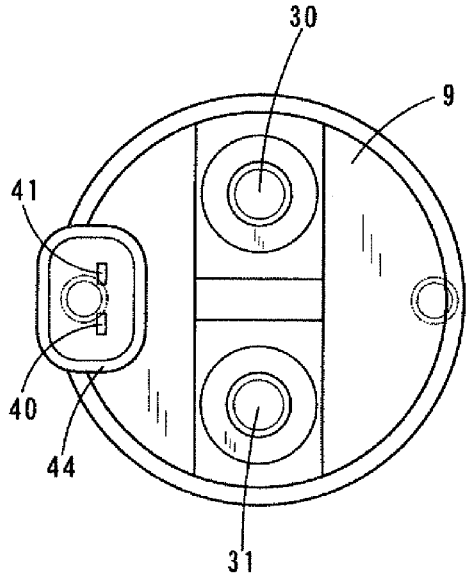
Figure 10:
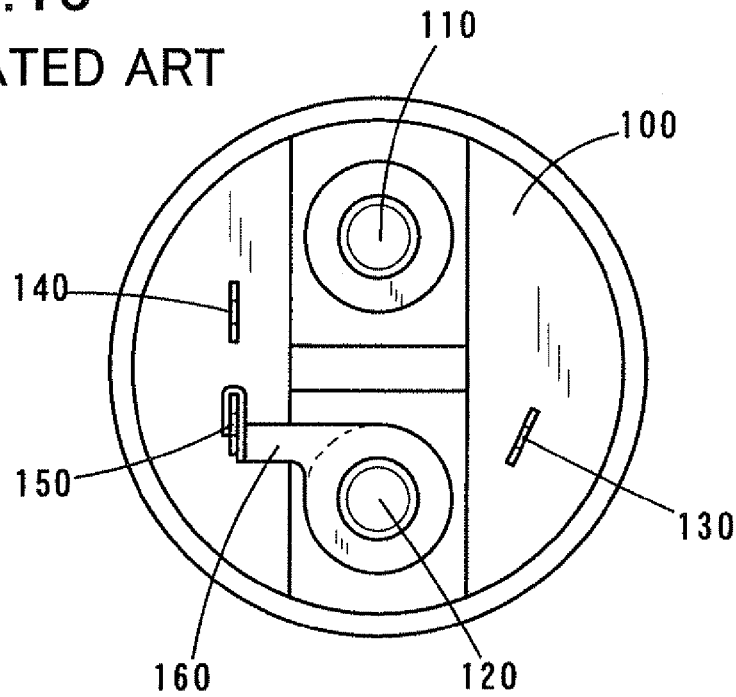
FIG.10 RELATED ART
FIG. 10 is an axial view showing a side of a conventional electromagnetic switch viewed from the cover side.
Figure 11:
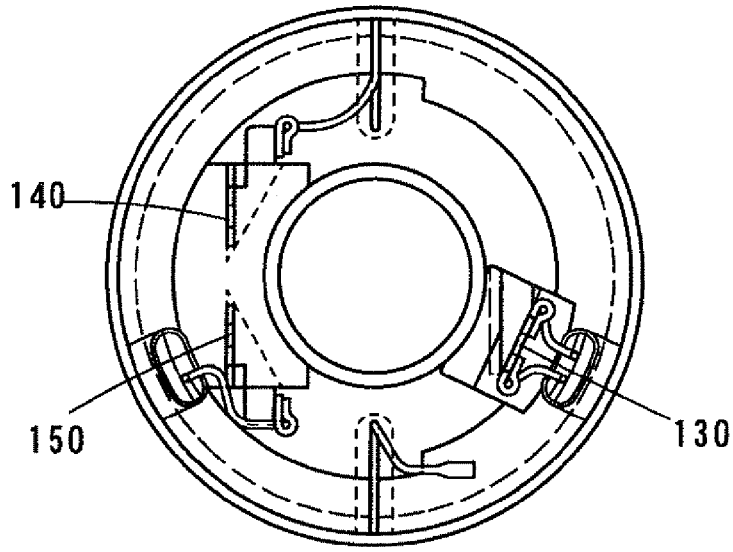
FIG.11 RELATED ART
FIGS. 11 to 14 are various side views showing a side of the conventional electromagnetic switch with its resin-made cover removed.
Figure 12:
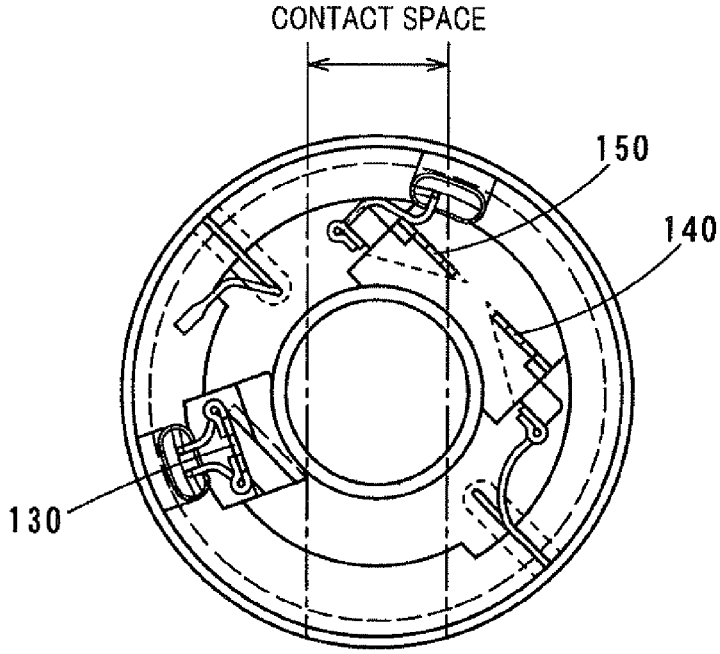
FIG.12 RELATED ART
Figure 13:
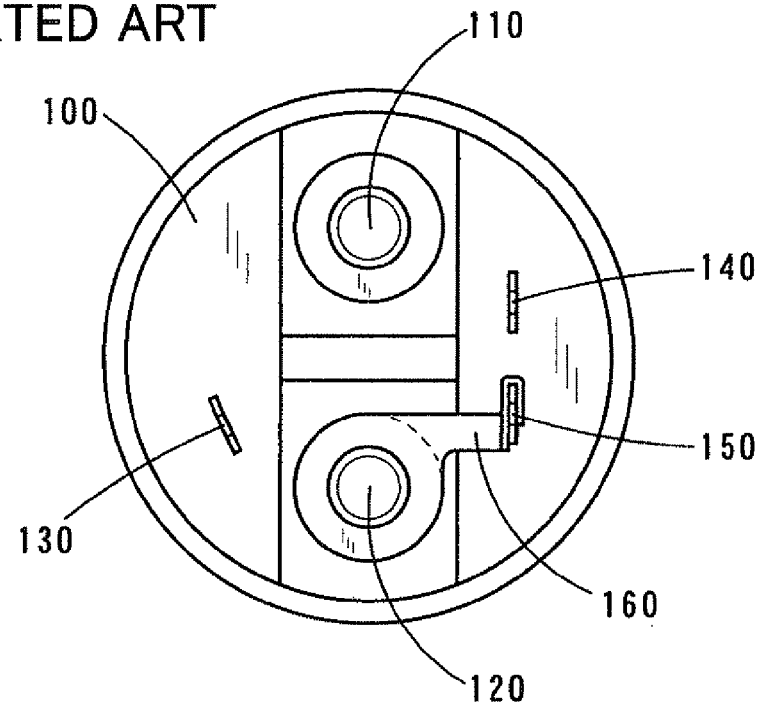
FIG.13 RELATED ART
Figure 14:
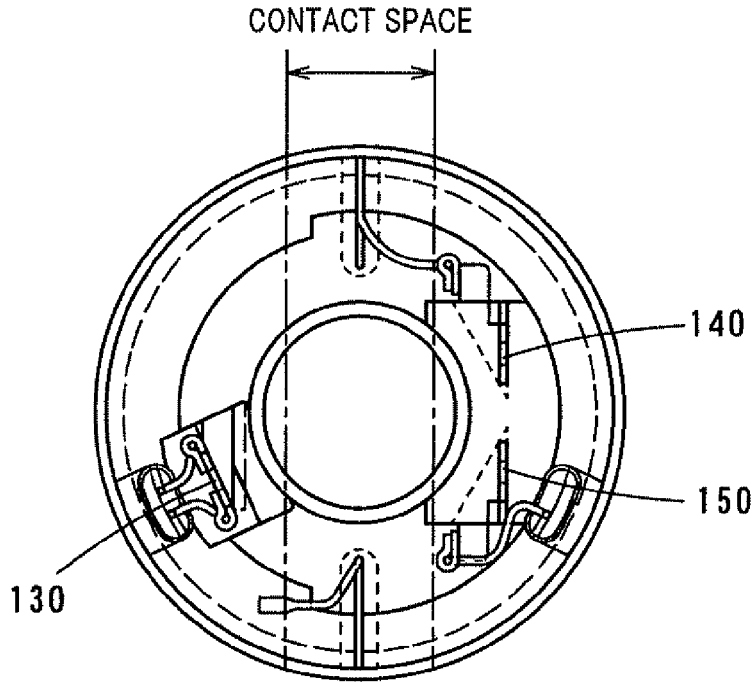
FIG.14 RELATED ART

As a result, it is only necessary to change the plastic cover 9 according to the variations of the position of the two excitation terminals 40, 41. Therefore a common electromagnet unit SU can be used for the variations, which can allow a reduction in component count and a simplification of the equipment for attachment. Incidentally FIGS. 9A, 9B and 9C shows states in which the plastic cover 9 is attached at each of the various terminal positions shown in FIGS. 8A, 8B, and 8C.

The parts of the two excitation terminals 40, 41 which are taken outside of the plastic cover 9 are not separately arranged in the both sides of a radical direction across the two terminal bolts 30, 31, but arranged in the one side of a radical direction across the two terminal bolts 30, 31, as shown in FIG. 28, FIG. 6, FIG. 9A, FIG. 9B and FIG. 9C.

Therefore the two excitation terminal bolts 30, 31 can be arranged on the opposite side from the engine block with respect to the two terminal bolts 30, 31. For example, the engine block is arranged in the left side with respect to the starter 2 in FIG. 6. This arrangement eliminates the need for wiring up one of the excitation terminals 40, 41 before attaching the starter 2 to the engine.

The two excitation terminals 40, 41 can be wired up after attaching the starter 2 to the engine. This eliminates the need for having twice wiring work before and after attaching the starter 2 to the engine, and improves work efficiency.

The plastic cover 9 is provided with the common connector fitting portion 44 surrounding the periphery of the first and second terminals 40, 41. This enables one time work for connecting the first and second terminals 40, 41 to connectors, and improves work efficiency for connecting.

Furthermore, the electromagnetic switch 1 of this embodiment has the rubber sealing part 43 which seals the two holes of the plastic cover 9. The common sealing part 43 is attached to the first and second excitation terminals 40, 41. This common use of the sealing part 43 can allow a reduction in component count and area needing to be sealed, so it is favorable for airtightness.

The first coil 13 consists of one coil, so the first electromagnet SL1 doesn't need the negative terminal as shown in the foregoing publication. Therefore the position of the two excitation terminals 40, 41 can be changed without respect to the negative terminal, so wiring is an advantage of one coil over two coils shown in the foregoing publication.

The first and second electromagnets SL1, SL2 of this embodiment are set in the cylindrical frame 8, the first and second electromagnets SL1, SL2 unified with arranged alongside in the axial direction of the frame 8. The frame 8 is long in the axial direction, in other words deep-seated. If the first and second electromagnets SL1, SL2 are separately inserted, it is difficult to insert the first electromagnet SL1 closer to the bottom of the frame 8 than the second electromagnet SL2.

Therefore the method of inserting the combination of the first and second electro magnets SL1, SL2 can shorten the attachment time in comparison with the method of inserting separately.

<Modifications>

The present invention may be applied to an electromagnetic switch made by inserting the first and second electromagnets SL1, SL2 inside of the frame 8 separately.

The first coil 13 of the first electromagnet SL1 may consist of not only one coil but also two or more coils as shown in the foregoing publications.

The present invention is not limited to the above-described embodiment and modifications. Modifications can be made accordingly without departing from the scope of the present invention.

What is claimed is:

1. An electromagnetic switch for a starter, comprising:

first and second excitation terminals each having a connecting end and a non-connecting end;

a first electromagnet which has a first coil excited by an electric current flowing via the first excitation terminal, the first coil generating a magnetic force to move a pinion gear of a starter in an axial direction;

a second electromagnet which has a main switch and a second coil excited by an electric current via the second excitation terminal, and which is configured to open and close the main switch depending on an excitation status of the second coil, the main switch making and breaking a current circuit electrically connected to a motor;

a frame in which the first and second electromagnets are set alongside each other in the axial direction, the frame extending along the axial direction, the frame having an open end in the axial direction;

a cover which covers the open end of the frame and forms a contact space inside of the cover, the main switch being arranged in the contact space;

two terminal bolts which are fixed to the cover, compose a part of the current circuit, and electrically connect the main switch and the motor; and a terminal fixing portion to which the connecting ends of the first and second excitation terminals are fixed together, the connecting ends being connected respectively to the first and second coils, the terminal fixing portion being disposed inside of the frame, wherein the first and second electromagnets are configured such that a relative position of the first and second electromagnets to the cover is changed by rotating about the axial direction.

2. The electromagnetic switch according to claim 1, wherein the first and second electromagnet are configured to set the first and second excitation terminals at a position out of the contact space by rotating about the axis.

3. The electromagnetic switch according to claim 1, wherein the terminal fixing portion is plastic-molded with a bobbin of the second coil as a unit, the second coil is wound around the bobbin.

4. The electromagnetic switch according to claim 1, wherein the non-connecting ends of the first and second excitation terminals are arranged together in one of both areas facing each other across the contact space.

5. The electromagnetic switch according to claim 1, wherein the non-connecting ends of the first and second excitation terminals are arranged adjacent to each other at one place of the cover.

6. The electromagnetic switch according to claim 5, further comprising a connector fitting portion which mutually surrounds the periphery of the other ends of the first and second excitation terminals.

7. The electromagnetic switch according to claim 1, further comprising a iron core which is arranged inside of the first and second coils to combine the first and second electromagnets, and which composes a part of a magnetic circuit, wherein the electromagnetic switch is formed by inserting the combination of the first and second electromagnets into the frame.

* * * * *